US010641480B2

(12) United States Patent
Crenn

(10) Patent No.: US 10,641,480 B2
(45) Date of Patent: May 5, 2020

(54) VIBRATION-INHIBITING BAR FOR A STEAM GENERATOR TUBE BUNDLE

(71) Applicant: AREVA NP, Courbevoie (FR)

(72) Inventor: Claude Crenn, Le Creusot (FR)

(73) Assignee: AREVA NP, Courbevoie (FR)

( * ) Notice: Subject to any disclaimer, the term of this patent is extended or adjusted under 35 U.S.C. 154(b) by 156 days.

(21) Appl. No.: 14/904,929

(22) PCT Filed: Jul. 17, 2014

(86) PCT No.: PCT/EP2014/065408
§ 371 (c)(1),
(2) Date: Jan. 13, 2016

(87) PCT Pub. No.: WO2015/007851
PCT Pub. Date: Jan. 22, 2015

(65) Prior Publication Data

US 2016/0146454 A1 May 26, 2016

(30) Foreign Application Priority Data

Jul. 19, 2013 (FR) ..... 13 57124

(51) Int. Cl.
*F22B 37/20* (2006.01)
*F22B 37/00* (2006.01)

(52) U.S. Cl.
CPC ..... *F22B 37/206* (2013.01); *F22B 37/002* (2013.01)

(58) Field of Classification Search
CPC ..... F22B 37/206; F22B 37/002
See application file for complete search history.

(56) References Cited

U.S. PATENT DOCUMENTS 4,204,570 A 5/1980 Eisinger
4,860,697 A 8/1989 Malaval
4,981,169 A 1/1991 Eisinger
5,072,786 A * 12/1991 Wachter ..... F22B 37/206 165/162

(Continued)

FOREIGN PATENT DOCUMENTS

DE 10202363 A1 3/2003
EP 0186957 A1 7/1986
JP S61-53686 U 4/1986
JP 2013-011380 A 1/2013

(Continued)

OTHER PUBLICATIONS

Sarne M. Hutcherson (Theoretical and Numerical Studies of the Air Damping of Micro-Resonators in the Non Continuum Regime); Nov. 2004; G. W. Woodruff School of Mechanical Engineering Georgia Institute of Technology.*

(Continued)

*Primary Examiner* — Gordon A Jones
(74) *Attorney, Agent, or Firm* — Greer, Burns & Crain Ltd.

(57) ABSTRACT

A vibration-inhibiting bar is provided that is interposed between bends of the tubes of two adjacent banks of tubes of a U tube bundle of a steam generator and includes at least one internal element, referred to as a damping element, designed to mechanically damp the vibrations of the tubes; and at least one external element, referred to as percussion element, in contact with the damping element, the percussion element being designed to be in contact with the bends of the tubes of the bundle.

7 Claims, 4 Drawing Sheets

(56) References Cited

U.S. PATENT DOCUMENTS

| | | | | |
|---|---|---|---|---|
| 5,692,557 | A * | 12/1997 | Gillet | F22B 37/206 122/510 |
| 7,032,655 | B2 * | 4/2006 | Wanni | F28F 9/013 165/162 |
| 9,200,002 | B2 | 12/2015 | Hodous et al. | |
| 9,697,919 | B2 * | 7/2017 | Wepfer | F22B 1/025 |
| 2007/0089856 | A1 * | 4/2007 | Wanni | F22B 37/205 165/69 |
| 2009/0020273 | A1 * | 1/2009 | Schneider | F28D 7/06 165/162 |
| 2012/0087720 | A1 * | 4/2012 | Kitamura | B23K 31/02 403/270 |
| 2012/0167839 | A1 * | 7/2012 | Wepfer | F22B 1/025 122/510 |
| 2014/0014295 | A1 * | 1/2014 | Umehara | F22B 1/025 165/69 |

FOREIGN PATENT DOCUMENTS

| | | |
|---|---|---|
| JP | 2013-108662 A | 6/2013 |

OTHER PUBLICATIONS

Sasajima et al. (Acoustic Analysis with Consideration of Damping Effects of Air Viscosity in Sound Pathway) World Academy of Science, Engineering and Technology International Journal of Mechanical and Mechatronics Engineering vol. 7, No. 6, 2013.*

Zerf, Preliminary Search Report for FR 1357124 dated Apr. 4, 2014.

Kermani, International Search Report and Written Opinion for PCT/EP2014/065408 dated Oct. 16, 2014.

Japanese Office Action from corresponding Japanese Patent Application No. 2016-526642, dated May 14, 2019.

Indian Examination Report from corresponding Indian Patent Application No. 201617001772, dated May 30, 2019.

* cited by examiner

VIBRATION-INHIBITING BAR FOR A STEAM GENERATOR TUBE BUNDLE

BACKGROUND

The technical field of the invention is the one of pressurized water nuclear plants. More particularly, the technical field of the invention is the one of steam generators for pressurized water nuclear reactors.

The present invention relates to an anti-vibration (vibration-inhibiting) bar for a steam generator tube bundle.

The sector of pressurized water nuclear reactors uses low-enriched uranium as a fuel and light water as a moderator and a coolant. These reactors are known as "indirect cycle" reactors because they include two distinct circuits: the primary circuit extracts the energy produced by the reactor and transfers it to the secondary circuit, which transforms it into steam and then into electricity.

FIG. 1 shows a steam generator 1 of a pressurized water nuclear reactor. The steam generator 10 includes an external shell 11 in which is provided, inside a bundle wrapper 12, a bundle 13 of tubes. The bundle of tubes is comprised of U-folded tubes 14. Each U-folded tube 14 has a first straight leg 14-1 and a second straight leg 14-2 connected by a semi-circular bend 14-3. The tubes 14 of the bundle 13 are arranged into several juxtaposed banks to constitute the bundle 13. A bank of tubes includes tubes 14 the bends 14-3 of which have radii different from one another and are placed adjacent in a same vertical plane, parallel to the first section plane P1 of FIG. 1. More precisely, the bends 14-3 of a same bank of tubes 14 have decreasing radii from the periphery of the bundle 13 to its centre part.

Thus, the bundle 13 has:

- a lower part of a substantially cylindrical shape and including the straight legs 14-1, 14-2 of the tubes 14 of the bundle 13;
- an upper part of a substantially hemispheric shape referred to as a tube bend region and including the bends 14-3 of the tubes 14 of the bundle 13.

FIG. 1 shows an inlet 15-1 and an outlet 15-2 of a fluid circulation primary circuit, as well as an inlet 16-1 and an outlet 16-2 of a fluid circulation secondary circuit. While the steam generator 10 is operating:

- high temperature pressurized water arrives through the inlet 15-1 of the primary circuit, circulates inside the tubes 14 of the bundle 13 and comes out through the outlet 15-2 of the primary circuit;
- feed water arrives through the inlet 16-1 of the secondary circuit, is brought into contact with the outer surface of the tubes 14, along which it moves in a vertical direction by being gradually brought to the boil, to finally come out at the outlet 16-2 of the secondary circuit as steam.

The primary fluid circulation inside the tubes 14 and the secondary fluid circulation in contact with the tubes 14 cause the tubes 14 to vibrate. In order to hold the tubes 14 and to prevent their colliding, straight legs 14-1, 14-2 of the tubes 14 are engaged into spacers 17 located at regular distances from one another along the height of the steam generator 10, and the bends 14-3 of the tubes 14 of the bundle 13, which constitute the tube bend region, are held by means of anti-vibration bars 18 each interposed between two banks of adjacent tubes of the bundle 13 and disposed along a radial direction of the tube bend region.

These anti-vibration bars 18 are generally hingedly connected in twos at their end 18-1 disposed inward of the tube bend region to constitute V-shaped structures. The outer ends 18-2 of the anti-vibration bars opposite their hinged end 18-1 are generally protruding with respect to the tubes constituting the external layer of the tube bend region. These outer ends 18-2 are generally fixed on fixing elements 19 placed on the upper surface of the tube bend region. The anti-vibration bars 18 therefore hold the bends 14-3 of the tube bend region for a maximum limitation of their vibrations, while enabling their expansion when the steam generator 10 is operating.

In order to facilitate the assembly of the tubes in the steam generator 10, an assembly clearance between the anti-vibration bars 18 and the bends 14-3 of the bundle is necessary. This clearance causes, when the steam generator 10 is in operation, residual vibrations of the bundle bends. These residual vibrations are accompanied by brief intense impacts and frictions generating premature wear and deterioration of the bundle bends at the contact areas with the anti-vibration bars.

SUMMARY

In this context, the invention presents a solution to the previously mentioned problems, by providing a anti-vibration device able to limit the vibrations of the tube bend region bends of a tube bundle in a steam generator, while minimizing wear and deterioration of the bundle bends at the tubes/anti-vibration bars contact areas, and therefore increasing their service life.

The invention therefore relates to an anti-vibration bar able to be interposed between the bends of the tubes of two adjacent banks of tubes of a U-shaped tube bundle of a steam generator and including:

- at least one internal element, referred to as a damping element, adapted to mechanically dampen the vibrations of the tubes;
- at least one external element, referred to as a percussion element, in contact with said damping element, said percussion element being adapted to be in contact with the bends of the tubes of the bundle.

Thanks to the invention, the damping element and the percussion element are used in order to limit the wear and deterioration of the bundle bends. Indeed, the wear is related to the distances of friction between the anti-vibration bar and the bundle bends, as well as to the intensity of the contact forces and to the repetition of the contacts.

The damping element in the anti-vibration bar according to the invention enables the absorption of impact energies to be improved, by mechanically alleviating the intensity of forces and the rebound energy after impact, and therefore by reducing the repetition of impacts.

Besides the characteristics which have just been mentioned in the previous paragraph, the anti-vibration bar according to the invention can have one or more additional characteristics among the following ones, taken individually or according to any technically possible combinations.

The anti-vibration bar includes a damping clearance between said damping element and said percussion element, said damping clearance comprising a fluid performing a viscous damping.

The percussion element includes a surface treatment able to improve its hardness. Thus, the wear of the percussion element is advantageously reduced.

The damping element is advantageously in the shape of a plate. Thus, several damping elements can be easily associated by being superimposed. Several damping elements are advantageously used by being superimposed. Indeed, a damping element undergoes, during an impact, a micro-deformation. In the case where said damping element is consecutive to a second damping element, the micro-deformation of said damping element results in a micro-friction of said damping element against the second damping element. This micro-friction generates a damping.

The anti-vibration bar advantageously includes:

an I-shaped profile having a core;

the damping element and a second damping element extending on either side of the I-shaped profile. The I-shaped profile aids in rigidifying the anti-vibration bar.

Alternatively, the damping element is formed by a flexible cable having a plurality of strands.

The anti-vibration bar advantageously includes:

a first support piece having a first groove;

a second support piece having a second groove;

the first and second support pieces being able to hold in position the damping element and the percussion element while providing a clearance between said damping element and said percussion element.

The anti-vibration bar of the invention advantageously has a damping clearance between two consecutive elements in which there is a fluid enabling a viscous damping to be performed. The fluid is for example air or liquid- and/or vapour-phase water. Thus, the combination of one or more damping elements and of one or more percussion elements is advantageously used to implement a viscous damping related to the fluid present between two consecutive damping and/or percussion elements. A plurality of damping elements is advantageously used in order to optimize this viscous damping.

The percussion element is advantageously a plate.

Alternatively, the percussion element is advantageously a tube surrounding a damping element.

The damping element is advantageously a tube. Thus, several damping tubes can be easily associated by being fitted into each other.

The invention also relates to a steam generator including:

a bundle of U-folded tubes, each tube having a semi-circular bend, the tubes being arranged in several banks, each bank including tubes the bends of which have radii different from one another and are placed adjacent in a same vertical plane, the bends forming a substantially hemisphere-shaped upper part of the bundle referred to as a tube bend region;

an anti-vibration bar according to the invention interposed between the bends of two adjacent banks of tubes and placed in a radial direction of the tube bend region.

The invention and its different applications will be better understood upon reading the following description and upon studying the accompanying figures.

BRIEF DESCRIPTION OF THE DRAWINGS

The figures are presented by way of indicating and in no way limiting purpose of the invention.

DETAILED DESCRIPTION

Figure 1:
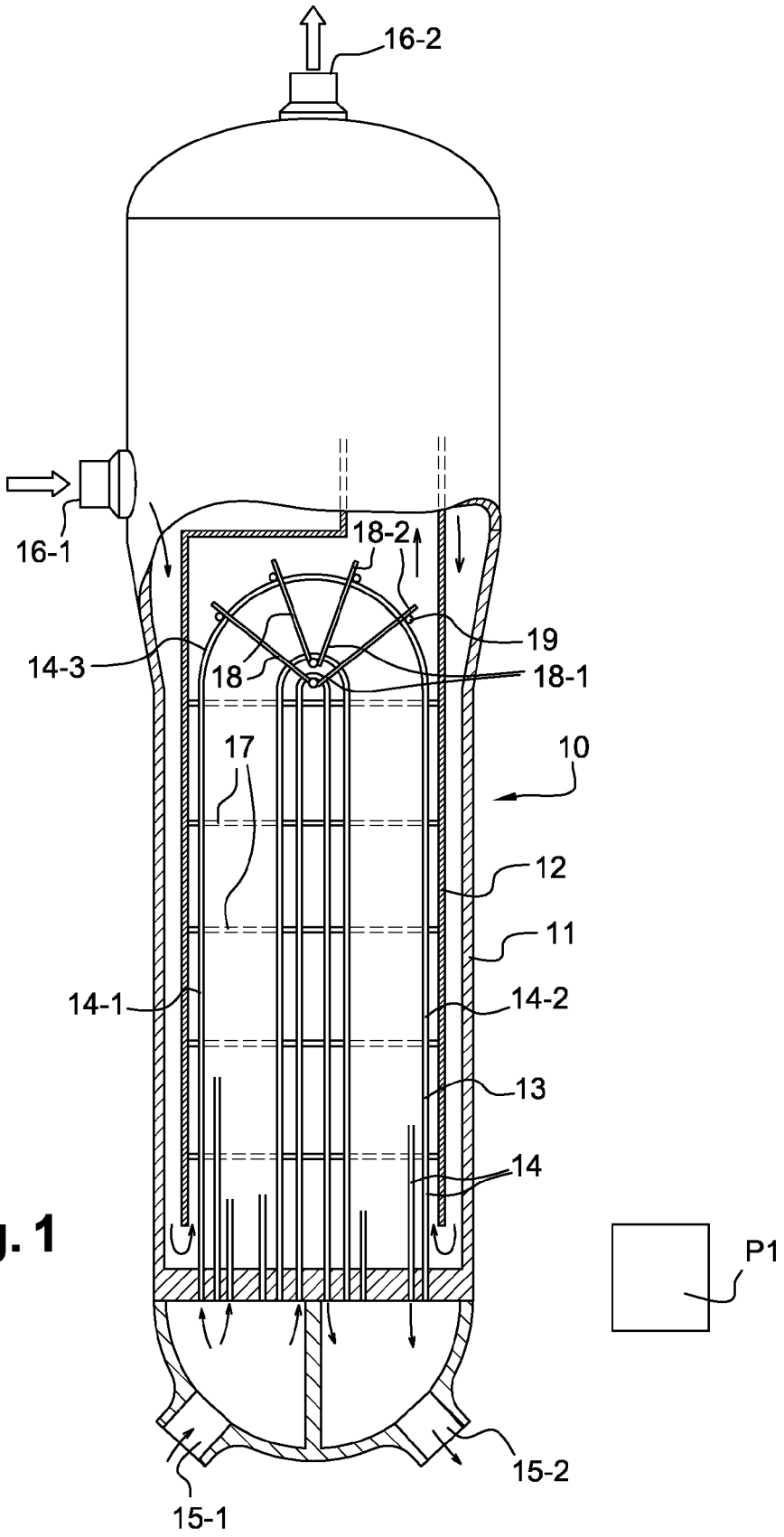
FIG. 1 shows a cross-section view of a steam generator of a pressurized water nuclear reactor.

Unless otherwise specified, a same element appearing in different figures bears a single reference numeral.

The invention relates to an anti-vibration bar 20 of a steam generator such as the steam generator 10 of the pressurized water nuclear reactor described in FIG. 1. The anti-vibration bar 20 according to a first embodiment of the invention is able to replace the anti-vibration bar 18 of the steam generator 10 of FIG. 1.

Previously described FIG. 1 shows a cross-section view, according to the first plane P1, of the steam generator 10 of the pressurized water nuclear reactor.

Figure 2:
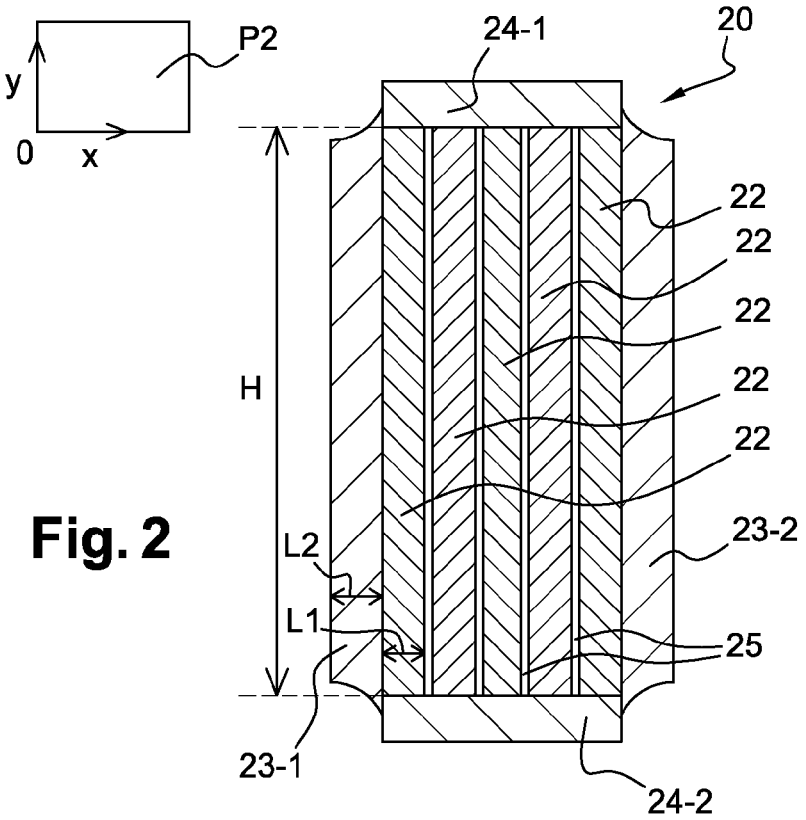
FIG. 2 shows a cross-section view of an anti-vibration bar according to a first embodiment of the invention.

FIG. 2 shows a cross-section view, according to a second plane P2 having a centre O and orthogonal axes x and y, said second plane P2 being perpendicular to the first plane P1, of the anti-vibration bar 20 according to the first embodiment of the invention.

The anti-vibration bar 20 includes:

a plurality of damping plates 22;

a first percussion plate 23-1 and a second percussion plate 23-2 extending on either side of the plurality of damping plates 22.

The damping plates 22 are advantageously made of a stainless material with a suitable roughness, able to provide a significant viscous damping. The first and second percussion plates 23-1 and 23-2 can undergo a surface treatment, such as a nitriding, in order to improve their hardness.

The damping plates 22 preferably have, along a direction Ox, a same width L1. Alternatively, the damping plates 22 can have, along the direction Ox, different widths. The damping plates 22 have, along a direction Oy, a same height H. Advantageously, two consecutive damping plates 22 have a clearance 25 between them. A fluid, for example air or liquid- and/or vapour-phase water, is trapped in the clearance 25, which enables a viscous damping to be created which is added to the mechanical damping of the damping plates 22.

In the example represented in FIG. 2, the percussion elements 23-1 and 23-2 are percussion plates, of a height H along the direction Oy. The first and second percussion elements 23-1 and 23-2 preferably have, along the direction Ox, a same width L2. Alternatively, the first and second percussion elements 23-1 and 23-2 can have, along the direction Ox, different widths. The damping plates 22 as well as the first and second percussion elements 23-1 and 23-2 are held together by a first weld bead 24-1 and by a second weld bead 24-2.

Figure 3:
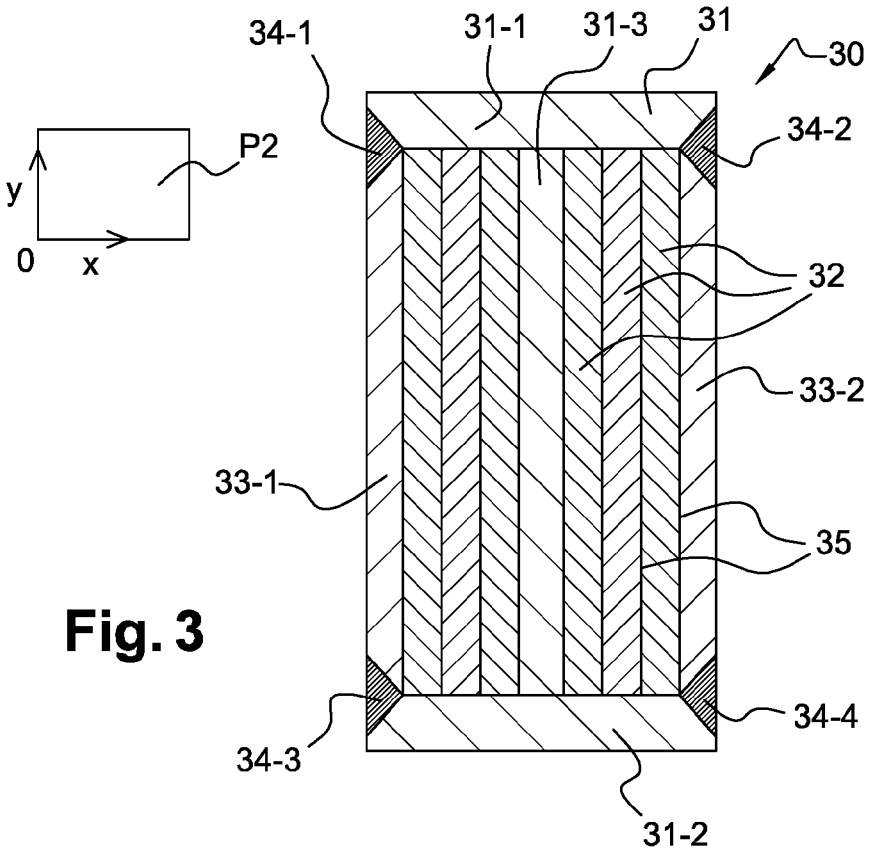
FIG. 3 shows a cross-section view of an anti-vibration bar according to a second embodiment of the invention.

FIG. 3 shows a cross-section view, along the second plane P2 having a centre O and orthogonal axes x and y, of an anti-vibration bar 30 according to a second embodiment of the invention.

The anti-vibration bar 30 according to the second embodiment of the invention includes:

an I-shaped profile 31 forming an element for rigidifying the anti-vibration bar 30;

a plurality of damping plates 32;

a first percussion plate 33-1 and a second percussion plate 33-2.

The I-shaped profile 31 has a first end 31-1 and a second end 31-2 connected by a core 31-3. The damping plates 32 extend between the first and second ends 31-1 and 31-2 of the profile 31 on either side of the core 31-3 of the profile 31. Similarly to the damping plates 22 according to the first embodiment, the damping plates 32 according to the second embodiment are advantageously made of a material able to provide a significant mechanical damping and two consecutive damping plates 32 advantageously have a clearance 35 between them. A fluid is trapped in the clearance 35, which enables a viscous damping to be created which is added to the mechanical damping of the damping plates 32.

The first and second damping plates 33-1 and 33-2 extend between the first and second ends 31-1 and 31-2 of the profile 31 and on either side of the damping plates 32. Similarly to the first and second percussion plates 23-1 and 23-2 according to the first embodiment, the first and second percussion plates 31-1 and 31-2 according to the second embodiment can undergo a surface treatment, such as a nitriding, in order to improve their hardness.

The first and second percussion plates 33-1 and 33-2 each have a first end and a second end. The first percussion plate 33-1 is attached, at its first end, to the first end 31-1 of the profile 31 thanks to a first weld bead 34-1. The second percussion plate 33-2 is attached, at its first end, to the first end 31-1 of the profile 31 thanks to a second weld bead 34-2. The first percussion plate 33-1 is attached, at its second end, to the second end 31-2 of the profile 31 thanks to a third weld bead 34-3. The second percussion plate 33-2 is attached, at its second end, to the second end 31-2 of the profile 31 thanks to a fourth weld bead 34-4.

The I-shaped profile 31 advantageously improves the stiffness of the anti-vibration bar 30.

Figure 4:
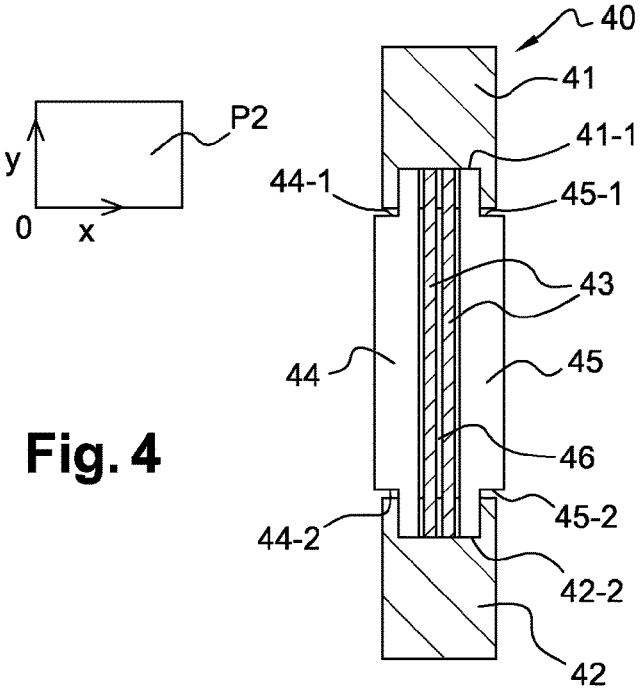
FIG. 4 shows a cross-section view of an anti-vibration bar according to a third embodiment of the invention.

FIG. 4 shows a cross-section view, along the second plane P2 having a centre O and orthogonal axes x and y, of an anti-vibration bar 40 according to a third embodiment of the invention.

The anti-vibration bar 40 according to the third embodiment of the invention includes:

- a first substantially parallelepiped support piece 41 having a first groove 41-1;
- a second substantially parallelepiped support piece 42 having a first groove 42-1;
- a plurality of damping plates 43, the ends of which are inserted on the one hand into a centre part of the first groove 41-1 of the first support piece 41 and on the other hand into a centre part of the second groove 42-1 of the second support piece 42;
- a first percussion plate 44 and a second percussion plate 45 extending on either side of the plurality of damping plates 43.

Similarly to the damping plates 22 according to the first embodiment and to the damping plates 32 according to the second embodiment, the damping plates 43 according to the third embodiment are advantageously made of a material able to provide significant mechanical damping and two consecutive damping plates 43 advantageously have a clearance 46 between them. A fluid is trapped in the clearance 46, which enables a viscous damping to be created, which is added to the mechanical damping of the damping plates 43.

The first percussion plate 44 has a first notch 44-1 at its first end and a second notch 44-2 at its second end. The first percussion plate 44 is embedded:

- into a first side part of the groove 41-1 of the first support piece 41 thanks to its first notch 44-1;
- into a first side part of the groove 42-1 of the second support piece 42 thanks to its second notch 44-2.

The second percussion plate 45 has a first notch 45-1 at its first end and a second notch 45-2 at its second end. The second percussion plate 45 is thus embedded:

- into a second side part of the groove 41-1 of the first support piece 41 thanks to its first notch 45-1;
- into a second side part of the groove 42-1 of the second support piece 42 thanks to its second notch 45-2.

Similarly to the first and second percussion plates 23-1 and 23-2 according to the first embodiment and to the first and second percussion plates 31-1 and 31-2 according to the second embodiment, the first and second percussion plates 44 and 45 according to the third embodiment can undergo a surface treatment, such as a nitriding, in order to improve their hardness.

The first and second support pieces 41 and 42 thus provide a holding in position of the first and second percussion plates 44 and 45 and of the damping plates 43 at their ends, while allowing a certain displacement of the percussion plates and of the damping plates, related to the presence of the clearance 46, during an impact between the anti-vibration bar 40 and a tube.

The first, second and third embodiments described until now implement a plurality of damping plates 22, 32, 43 and first 23-1, 31-1, 44 and second 23-2, 31-2, 45 percussion plates, the damping plates and the percussion plates forming pieces separated from the anti-vibration device. Nevertheless, according to an alternative of the first, second and third embodiments, the damping plates and the percussion plates could be merged. According to this alternative, the percussion plates are formed by the external surfaces of the damping plates that can have improved hardness properties.

Figure 5A:
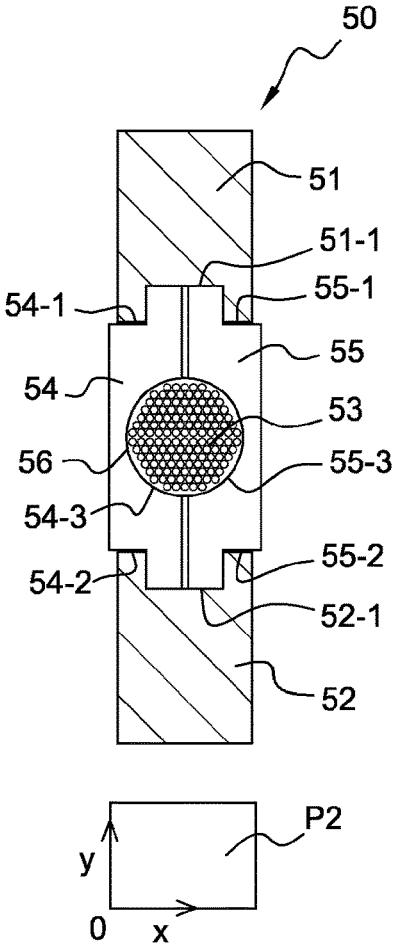
FIG. 5*a* shows a cross-section view of an anti-vibration bar according to a fourth embodiment of the invention.

FIG. 5*a* shows a cross-section, along the second plane P2 having a centre O and orthogonal axes x and y, of a anti-vibration bar 50 according to a fourth embodiment of the invention.

The anti-vibration bar 50 according to this fourth embodiment of the invention includes:

- a first substantially parallelepiped support piece 51 having a first groove 51-1;
- a second substantially parallelepiped support piece 52 having a second groove 52-1;
- a flexible damping cable 53 including a plurality of strands;
- a first percussion plate 54 and a second percussion plate 55.

The first percussion plate 54 has a first notch 54-1 at its first end and a second notch 54-2 at its second end. The first percussion plate 54 is embedded:

- into a first side part of the groove 51-1 of the first support piece 51 thanks to its first notch 54-1;
- into a first side part of the groove 52-1 of the second support piece 52 thanks to its second notch 54-2.

The second percussion plate 55 has a first notch 55-1 at its first end and a second notch 55-2 at its second end. The second percussion plate 55 is embedded:

- into a second side part of the groove 51-1 of the first support piece 51 thanks to its first notch 55-1;
- into a second side part of the groove 52-1 of the second support piece 52 thanks to its second notch 55-2.

Furthermore, the first percussion plate 54 has a first semi-circular cavity 54-3, and the second percussion plate 55 has a second semi-circular cavity 55-3. The first and second semi-circular cavities 54-3 and 55-3 are thus able to form, when they are positioned facing each other, a circular cavity 56. The circular cavity 56 is able to accommodate the damping cable 53.

The damping cable 53 is a flexible cable comprised of a plurality of strands able to deform and form a mechanical damping during an impact with a tube.

An operational clearance advantageously exists between the first percussion plate 54, the damping cable 53 and the second percussion plate 55. This operational clearance accommodates a fluid which enables a viscous damping to be created. This viscous damping is added to the mechanical damping of the damping cable 53.

Similarly to the first percussion plate 23-1, 31-1, 44 and to the second percussion plate 23-2, 31-2, 45 according to the previous embodiments, the first and second percussion plates 54 and 55 according to the first alternative of the fourth embodiment of the invention can undergo a surface treatment, such as a nitriding, in order to improve their hardness.

The first and second support pieces 51 and 52 thus provide the holding in position of the first and second percussion plates 54 and 55 at their ends, while allowing a certain displacement of the percussion plates and of the damping cable 53, related to the presence of the operational clearance, during an impact between the anti-vibration bar 50 and a tube.

Figure 5B:
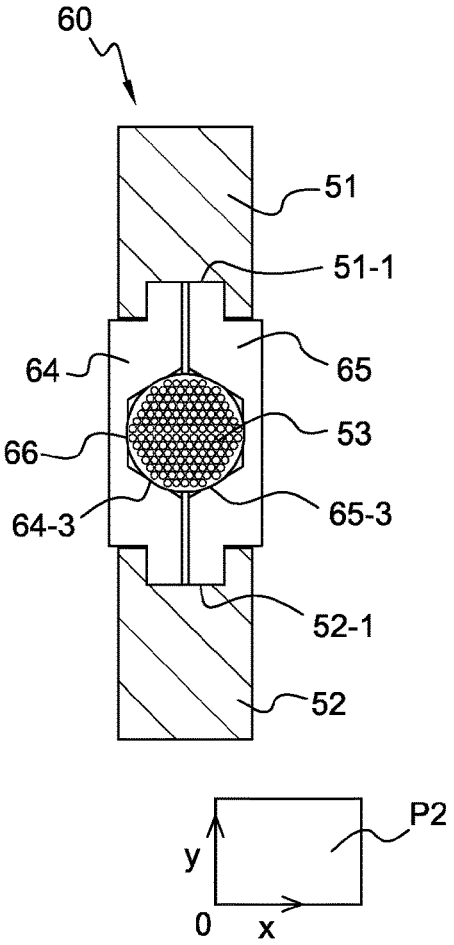
FIG. 5*b* shows a cross-section view of an anti-vibration bar according to an alternative fourth embodiment of the invention.

FIG. 5*b* shows a cross-section view, along the second plane P2 having a centre O and orthogonal axes x and y, of an anti-vibration bar 60 according to an alternative of the previously described fourth embodiment of the invention.

The anti-vibration bar 60 according to this alternative embodiment is identical to the previously described anti-vibration bar 50 except for the percussion plates.

The anti-vibration bar 60 indeed includes:

a first percussion plate 64 having a first trapezoid cavity 64-3;

a second percussion plate 65 having a second trapezoid cavity 65-3.

The first and second trapezoid cavities 64-3 and 65-3 are thus able to form, when they are positioned facing each other, a hexagonal cavity 66. The hexagonal cavity 66 is able to accommodate the damping cable 53.

The advantage of this alternative is to enable a greater radial deformation of the damping cable 53 submitted to the compression, and thus a greater mechanical damping.

Figure 6:
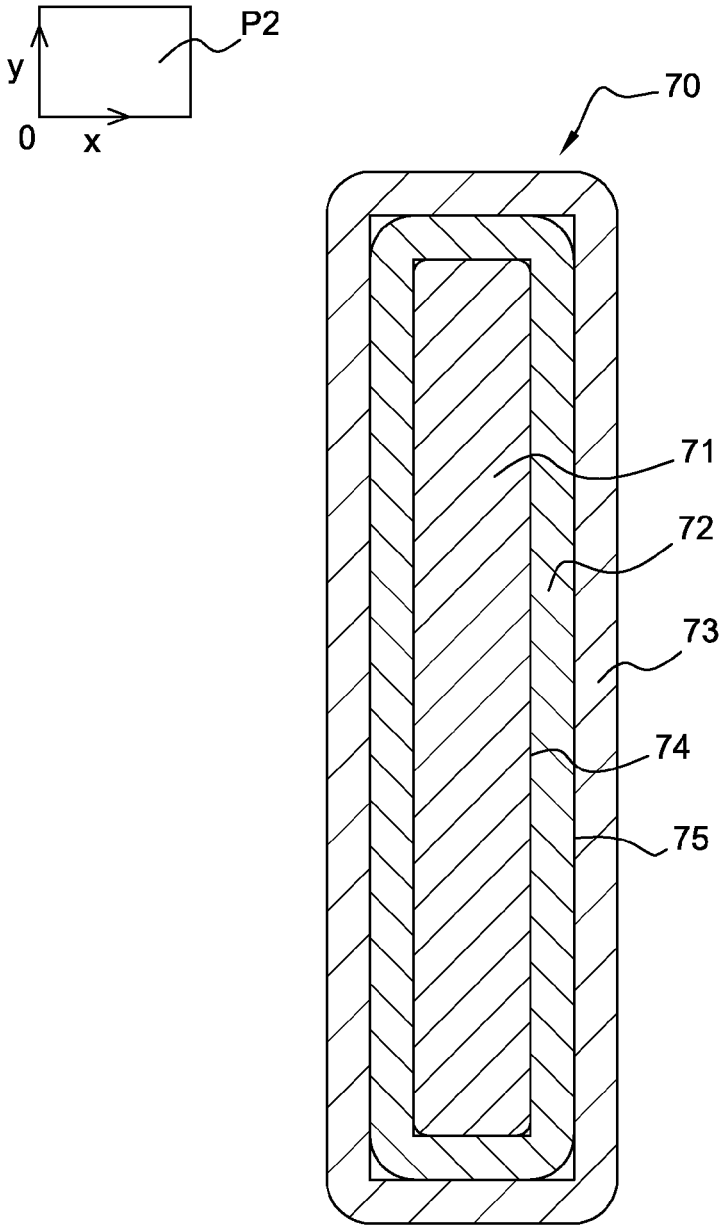
FIG. 6 shows a cross-section view of an anti-vibration bar according to a fifth embodiment of the invention.

FIG. 6 shows a cross-section view, along the second plane P2 having a centre O and orthogonal axes x and y, of an anti-vibration bar 70 according to a fifth embodiment of the invention.

The anti-vibration bar 70 according to this fourth embodiment of the invention includes:

a damping plate 71 forming a solid core of the anti-vibration bar 70;

a damping tube 72 surrounding the damping plate 71;

a percussion tube 73 surrounding the damping tube 72.

The thickness of the walls of the damping tube 72 and of the percussion tube 73 is for example of 0.5 mm.

The damping plate 71 and the damping tube 72 are advantageously made of a material able to provide a significant mechanical damping. The damping plate 71 and the damping tube 72 advantageously have a clearance 74 between them. Similarly, the damping tube 72 and the percussion tube 73 advantageously have a clearance 75 between them. A fluid is trapped in the clearance 74 and in the clearance 75, which enables a viscous damping to be created which is added to the mechanical damping of the damping plate 71 and the damping tube 72.

The invention claimed is:

1. An anti-vibration bar able to be interposed between bends of tubes of two adjacent banks of tubes of a U-shaped tube bundle of a steam generator, the anti-vibration bar comprising:

a plurality of internal elements, referred to as a plurality of damping elements, adapted to mechanically dampen the vibrations of the tubes of the two adjacent banks of tubes;

two external elements, referred to as percussion elements, at least one of the two external elements being adjacent to a first damping element of said plurality of damping elements, said percussion elements being configured to be in contact with the bends of the tubes, said percussion elements extending on either side of the plurality of damping elements;

a first damping clearance between said first damping element and one of said percussion elements; and a second damping clearance between a second damping element of said plurality of damping elements, and said first damping element, or between said second damping element and a third damping element of the plurality of damping elements, said first damping clearance including a first portion of a fluid trapped in said first damping clearance, said first portion of the fluid performing a viscous damping between said first damping element and said one of said percussion elements, and said second damping clearance including a second portion of the fluid trapped in said second damping clearance, said second portion of the fluid performing a viscous damping between said first damping element and said second damping element or between said second damping element and said third damping element wherein the first damping element, the second damping element, and the third damping element are parallel to each other.

2. The anti-vibration bar according to claim 1, wherein at least one of said plurality of damping elements is in the shape of a plate.

3. The anti-vibration bar according to claim 1, further comprising:

an element presenting an I-shaped profile and having a core;

said plurality of damping elements each extending on either side of the core.

4. The anti-vibration bar according to claim 1, wherein the percussion elements are plates.

5. The anti-vibration bar according to claim 1, wherein the first portion of the fluid trapped in said first damping clearance and the second portion of the fluid trapped in the second damping clearance are the same.

6. The anti-vibration bar according to claim 1, wherein each percussion element of the percussion elements includes a surface treatment able to improve its hardness.

7. The anti-vibration bar according to claim 1, wherein the percussion elements are held together by at least a weld bead.

* * * * *